United States Patent [19]
Nakaoka
[11] 4,238,937
[45] Dec. 16, 1980

[54] FABRIC MANIPULATING DEVICE FOR MANIPULATING THE LOOPS OF A KNITTED FABRIC

[75] Inventor: Mitsuo Nakaoka, Kodaira, Japan
[73] Assignee: Silver Seiko, Ltd., Kodaira, Japan

[21] Appl. No.: 54,944
[22] Filed: Jul. 5, 1979
[30] Foreign Application Priority Data
Oct. 31, 1978 [JP] Japan ..... 53-148881[U]
[51] Int. Cl.³ ..... D04B 7/00
[52] U.S. Cl. ..... 66/60 H; 66/73; 66/70; 66/67; 66/76
[58] Field of Search ..... 66/60, 60 H, 76, 67, 66/72, 70, 73, 78, 67

[56] References Cited
U.S. PATENT DOCUMENTS
3,861,174 1/1975 Kunisada ..... 66/60
FOREIGN PATENT DOCUMENTS
47-28421 7/1972 Japan .
48-8780 3/1973 Japan .
51-12100 4/1976 Japan .
51-40362 10/1976 Japan .

*Primary Examiner*—Ronald Feldbaum
*Attorney, Agent, or Firm*—Lane, Aitken, Ziems, Kice & Kananen

[57] ABSTRACT
A fabric manipulating device for use with a knitting machine of the type having a flat needle bed containing a plurality of equi-spaced knitting needles tricked into the bed includes a carrier that is mounted on the bed for sliding, needle-by-needle movement along the bed to effect loop manipulation. A cam-controlled linking needle is mounted on the carrier in the plane of the knitting needle in opposing relationship thereto for movement to and from the knitting needles to effect the intended knitted loop linking manipulation. A cam-controlled positioning member and loop restricting member, operating in timed relationship with a cam-controlled loop expanding mechanism and stationary loop contacting surfaces, orients and expands a knitted loop retained on the stem of a knitting needle opposing the linking needle to permit the linking needle to enter the expanded loop while a cam-controlled actuator causes the knitting needle to knock-over the loop onto the linking needle. A cam-controlled incrementing mechanism increments the carrier from needle-to-needle while the linking needle and related mechanisms cyclically operate to effect the loop linking operation.

14 Claims, 27 Drawing Figures

FABRIC MANIPULATING DEVICE FOR MANIPULATING THE LOOPS OF A KNITTED FABRIC

BACKGROUND OF THE INVENTION

The present invention relates to a device for manipulating a knitted fabric and, more particularly, to a device for use with a knitting machine for linking the knitted loops formed by the machine.

In the manufacture of knitted fabrics, the knitted loops on the terminal or end course of the fabric are frequently linked to one another by manual manipulation of a conventional tappet tool that includes a hook and latch similar to those of the latch-type knitting needles. As shown in FIG. 27, when the end or terminal loops are so linked, a selected knitted loop extends through the next adjacent loop on one side of the selected loop with the next adjacent loop on the other side of the selected loop extending through the selected loop in a manner analogous to chain stitching. This type of loop linking may be accomplished with the knitted fabric mounted on the knitting machine by advancing the knitting needles to their forward most position so that the top most needle loops are carried on the stem portions of the knitting needles with the latches pivoted onto the stems. A conventional tappet tool is passed through the loop on the end most needle so that the needle carries the loop on its stem with the latch pivoted onto the stem. The end knitting needle is then lowered to its most retracted position to clear the end loop. The tool is then passed through the second loop on the next adjacent knitting needle so that the second loop is carried on the hook of the tappet tool. The second knitting needle is then lowered to its most retracted position so that the second loop is cleared and received on the hook of the tappet tool. The tool is then pulled in an axial direction so that the first loop is removed therefrom to pivot the latch onto the hook and pull the second loop through the first loop to effect the desired linking. The tappet tool is then manipulated in a similar manner so that the third knitted loop is passed through the second loop and the sequence continued until all of the end course loops are so linked. At the final stage, the end of the knitting yarn from the last loop is passed therethrough to prevent unravelling of the so linked fabric thereby completing the intended linking operation.

SUMMARY OF THE INVENTION

It is an object of the present invention, among others, to provide a device for use with a knitting machine that effects the above described linking operation by mechanical means in an efficient and reliable manner and pursuant to this object, and others, the present invention provides a fabric manipulating device for manipulating the knitted loops of a knitted fabric on a knitting machine which includes a linking needle mounted on a carrier that is movable in a needle-by-needle sequence along a needle bed of the knitting machine. The linking needle is located at the same elevation as the knitting needles in opposite relationship thereto and controlled by a cam for movement to and from the knitting needles. A cam-controlled positioning member and loop restricting member, in cooperation with a cam-controlled loop expanding member and stationary loop contact surfaces, operate in timed relationship to one another to position and expand a knitted loop on a selected knitting needle while the linking needle passes through the expanded loop and a cam-controlled knitting needle cam retracts the knitting needle to its rearward position to knock-over the expanded loop onto the linking needle. A cam-operated incrementing mechanism operates to increment the carrier in a needle-by-needle sequence along the needle bed while the linking needle and its associated cam-operated mechanisms and the stationary loop contact surfaces function to effect the linking operation.

BRIEF DESCRIPTION OF THE DRAWINGS

The above description, as well as the objects, features, and advantages, of the present invention will be more fully appreciated by reference to the following detailed description of a presently preferred, but nonetheless illustrative, embodiment in accordance with the present invention, when taken in conjunction with the accompanying drawings wherein.

DESCRIPTION OF THE PREFERRED EMBODIMENT

Figure 7:
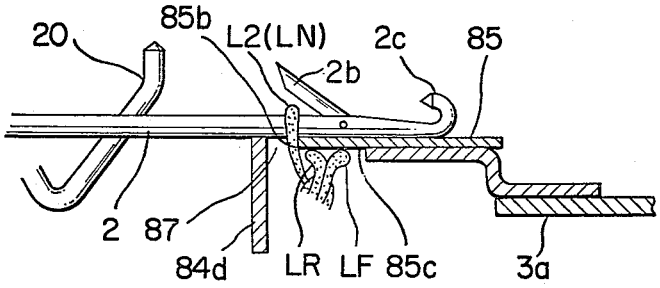
FIG. 7 is an enlarged detailed view, in cross-section, of a knitting needle and associated stationary loop contact surfaces along line 7—7 of FIG. 5.
Figure 26:
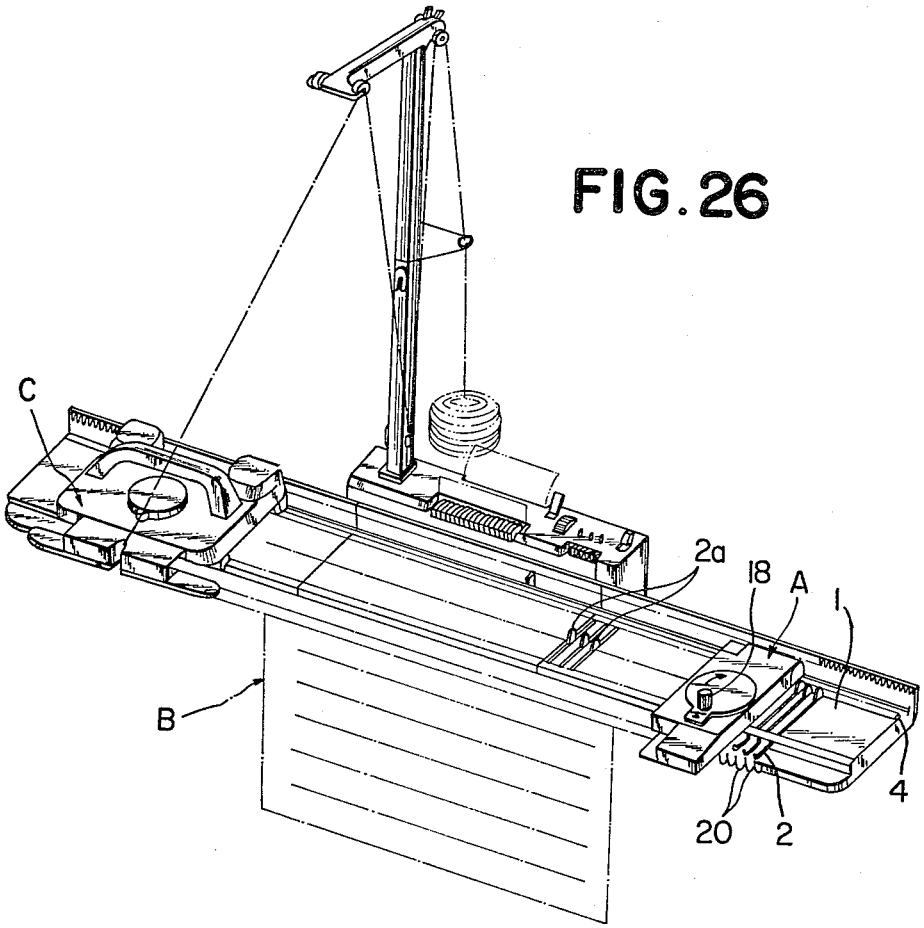
FIG. 26 is a perspective view of a knitting machine incorporating the fabric manipulating device of the present invention.

A preferred embodiment of a fabric manipulating device in accordance with the present invention is shown in FIG. 26 and is generally referred to therein by the reference character A. The manipulating device A is shown mounted on a hand-operated, flat-bed knitting machine of a known type intended for domestic use. The knitting machine includes a flat, longitudinally extending needle bed 1 containing a large number of latch-type knitting needles 2 tricked into the bed 1 in a spaced, side-by-side relationship to one another. A guide bar or rail 4 is located rearwardly of the needle bed 1 and extends along the length of the bed. The rail 4 supports the fabric manipulating device A of the present invention and a knitting carriage or head C for movement along the length of the needle bed 1. The latch needles 2 are of conventional design and include (FIG. 7) a hook 2*c*, a swinging or pivoting latch 2*b*, and (FIG. 2) a butt 2*a* that extends above the needle bed 1 and that is adapted to contact cam(s) on the knitting carriage C to effect the various needle movements to provide a knitted fabric B from a supply of yarn.

Figure 1:
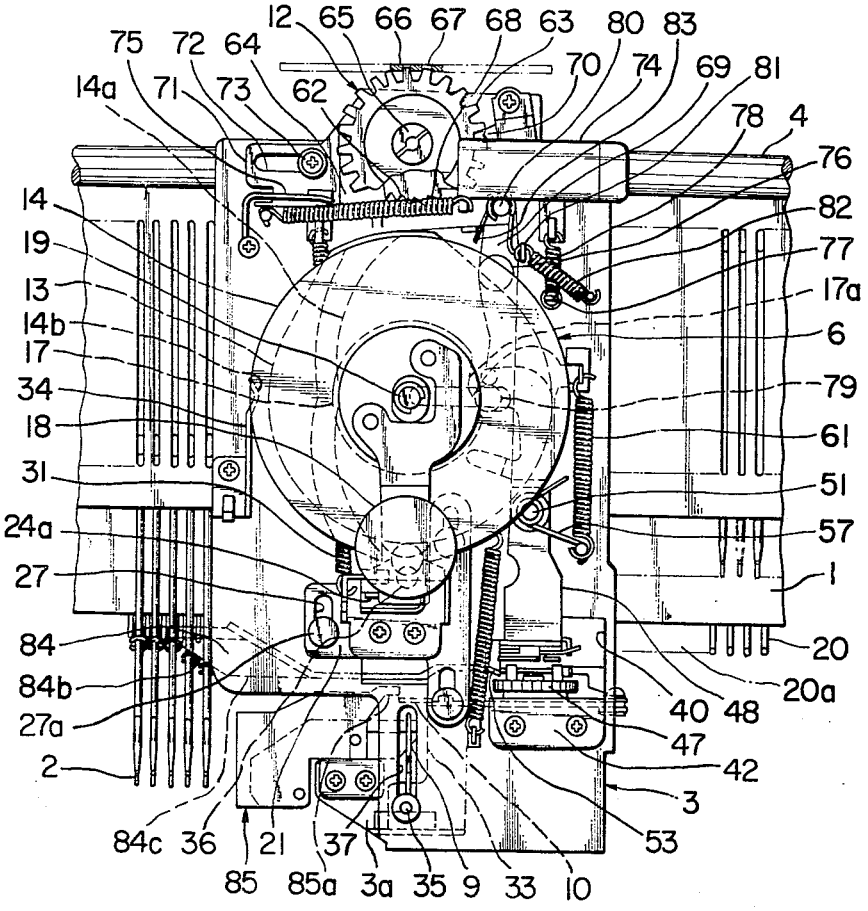
FIG. 1 is a plan view of a fabric manipulating device in accordance with the present invention mounted on a needle bed of a knitting machine with the cover of the manipulating device removed to show the internal organization thereof.
Figure 2:
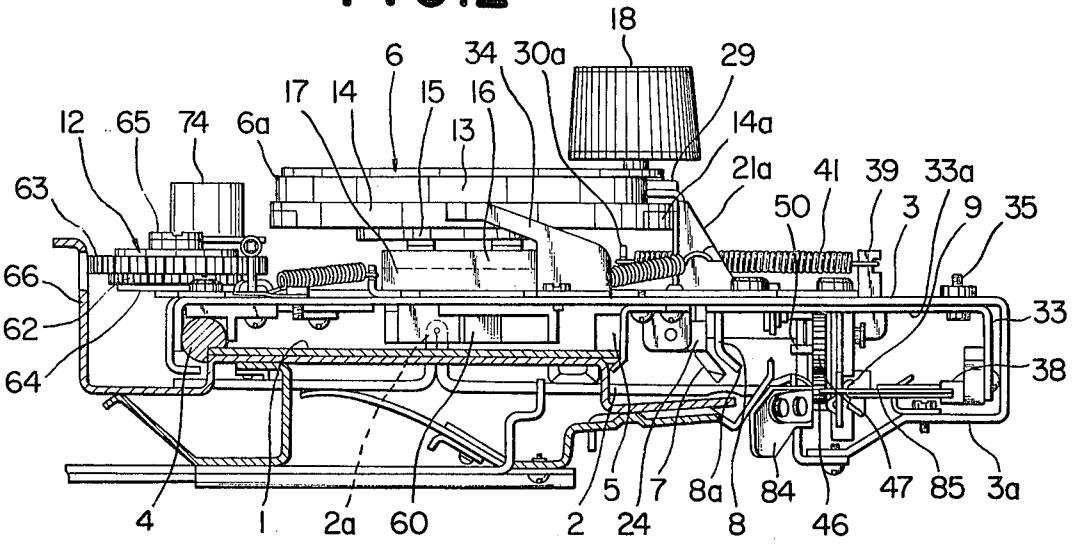
FIG. 2 is a side elevational view, in partial cross-section, of the fabric manipulating device of FIG. 1 as viewed from the left in FIG. 1.
Figure 3:
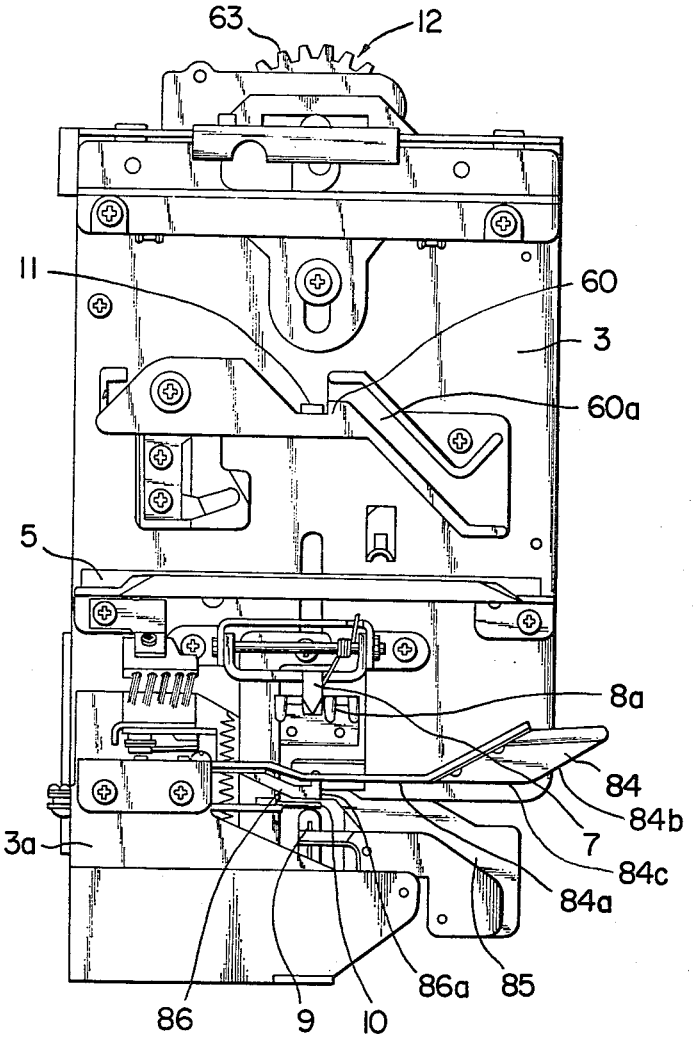
FIG. 3 is a bottom view of the fabric manipulating device shown in FIGS. 1 and 2.

As shown in FIGS. 1, 2, and 3, the fabric manipulating or linking device A of the present invention includes a carrier 3 that is mounted on the needle bed 1 for movement in the longitudinal direction along the length of the bed (that is, from the right to the left as viewed in FIGS. 1 and 26). The carrier 3 has a substantially rectangular shape and is mounted at its rear edge on the guide rail 4 for sliding movement relative thereto. A slider 5 (FIG. 2) is provided on the underside of the carrier 3 to engage and slide relative to the forward edge of the needle bed 1.

A track cam 60 (FIG. 3) is secured to the underside of the carrier 3 by suitable threaded fasteners and includes a downwardly facing track or guideway 60*a* that is adapted to engage the upwardly extending butts 2*a* of the needles as the carrier 3 moves along the guide rail 4. The butts 2*a* enter the guideway 60*a* when they are in their projected, forward position (as indicated by the five left-most needles in FIG. 1) and are retracted toward and to their rearward position as the carrier 3 moves along the guide rail 4.

A multiple cam actuator mechanism, generally designated by the reference character 6, is centrally mounted on the upper side of the carrier 3 and is connected, through various cam follower mechanisms described in detail below, to a loop expanding member 7, a positioning member 8, a linking needle 9, a loop restricting or suppressing member 10, a needle operating cam 11, and a carrier incrementing or feed mechanism 12.

As shown in FIGS. 1 and 2, the actuator mechanism 6 includes a cam block 6*a* having five actuator cams 13, 14, 15, 16, and 17 mounted in a stacked or overlapping relationship. The cams are rotatably mounted on a shaft 19 that extends upwardly from the carrier 3 and are manually rotatable about the shaft 19 by a handle 18. The cams are so mounted relative to one another and to their respective cam follower mechanisms such that one full revolution of the actuator mechanism in the clockwise direction will manipulate one loop of the knitted fabric as described above.

The upper most cam, cam 13, is operatively connected through its cam follower mechanism to both the loop expanding member 7 and the positioning member 8; the cam 14 is operatively connected to the linking needle 9; the cam 15 is operatively connected to the loop restricting or suppressing member 10; the cam 16 is operatively connected to the needle operating cam 11; and the lower most cam, cam 17, is operatively associated with the carrier feed mechanism 12.

As shown in FIG. 2, the loop expanding member 7 and the positioning member 8, which are both operatively associated with the cam 13, are located on the underside of the carrier 3 at a position forward of the slider 5.

The positioning member 8 is formed as a substantial L-shaped strip having depending tabs or projections 8*a* formed on the lower edge. The pitch or spacing of the projections 8*a* is substantially equal to the pitch of sinker elements 20 and, as explained below, the projections 8*a* are adapted to enter the space between adjacent sinker elements 20 and thereby positively position the carrier 3 relative to the sinker elements 20 and the knitting needles 2. The upper edge of the positioning member 8 extends through an opening 25 (FIG. 4) formed through the carrier surface and is secured to the underside of a slide plate 21 with the projections 8*a* extending (as shown in FIG. 2) in a downward and forward direction from behind (that is, rearwardly) of the sinker elements 20.

Figure 9:
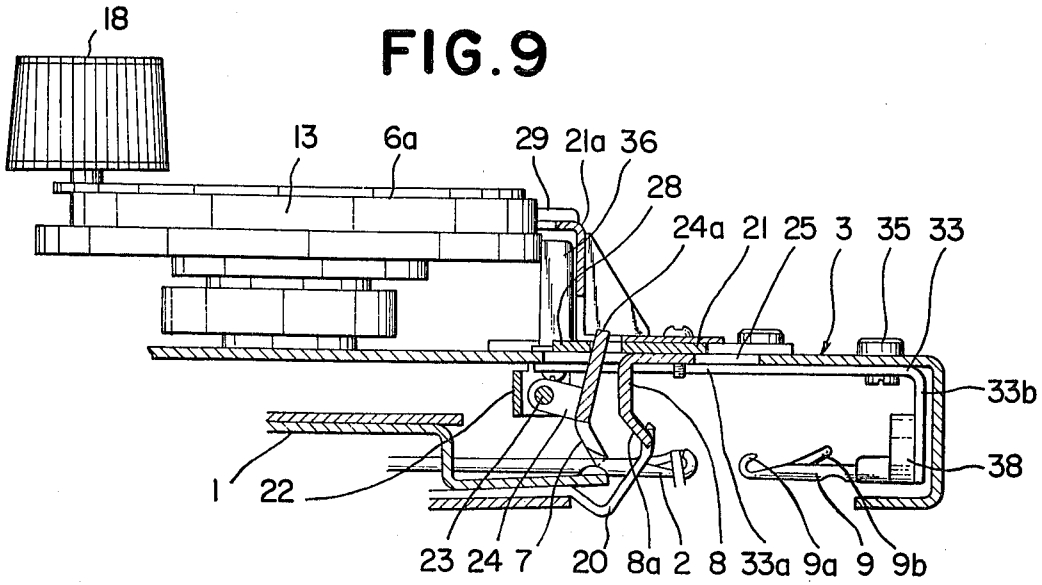
FIG. 9 is a partial side elevational view, in cross-section, taken along line 9—9 of FIG. 8.
Figure 10:
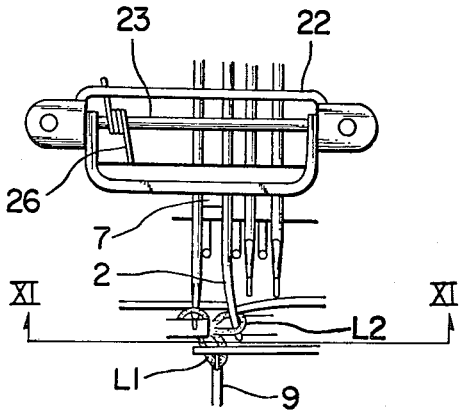
FIG. 10 is a detailed plan view illustrating the loop expanding member entering the space between two adjacent knitting needles to deflect one of the needles.

As shown in FIGS. 2, 9, and 10 the loop expanding member 7 is formed as a tooth that extends downwardly from the lower edge of a bail 24. The bail 24 is pivotally mounted on a support shaft 23 carried by a bracket 22 secured to the underside of the carrier 3. The opposite sides of the tooth are inclined toward one another to provide a tapered or wedge-like form that, as described below, is adapted to enter the space between two adjacent needles 2. Another tab 24*a* (FIG. 9) extends upwardly from the bail 24 through the opening 25 and functions, in the manner described below, to cause the bail 24 to pivot about its shaft 23.

Figure 8:
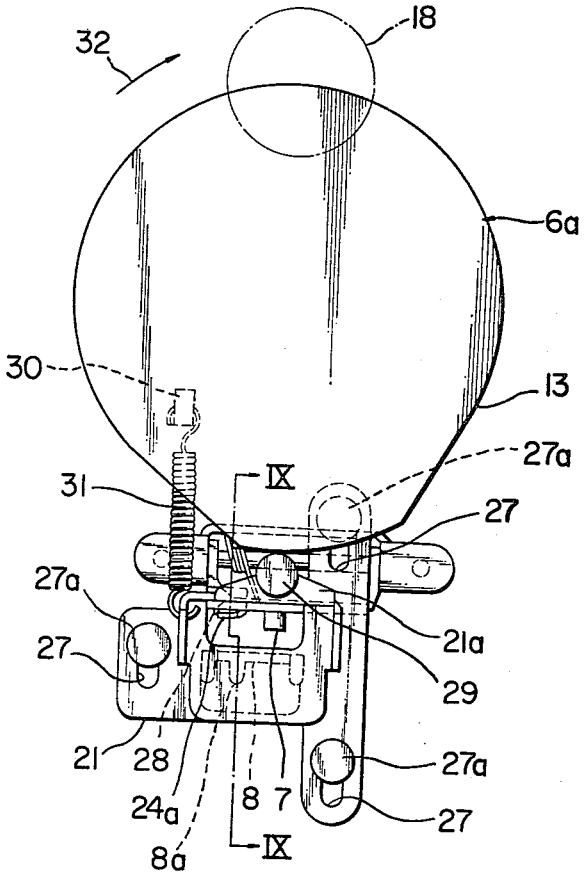
FIG. 8 is a partial plan view, in diagrammatic form, showing the operative relationship between a positioning member and a loop expanding member and their actuator cam.

The substantially flat slide plate 21 is formed with elongated slots 27 in its opposite side portions. Mounting pins 27*a*, secured to the carrier 3, extend upwardly through the slots 27 with each pin 27*a* including an enlarged head portion to retain the slide plate 21 on the surface of the carrier 3 for sliding movement in a direction substantially transverse to the longitudinal axis of the needle bed 1. The slide plate 21 is positioned generally above the opening 25 and has a rear extension 28 (FIGS. 8 and 9) that is adapted to contact and move the upwardly extending tab 24*a*. A riser 21*a* is secured to the upper side of the slide plate 21 (FIG. 4) and has a roller-type cam follower 29 rotatably mounted on a top surface thereof. The cam follower is located at the same elevation as the cam 13 (FIG. 2) and is resiliently urged against the peripheral surface of the cam 13 by a spring 31 which extends, in tension, between a notch formed in the sidewall of the riser 21*a* and a lug 30 (FIG. 8).

When the cam 13 is at its initial position as shown in FIG. 1 (that is, the handle 18 in the forward most position) the loop expanding member 7 and the positioning member 8 are both in their respective inoperative positions. When the cam is rotated in the clockwise direction by manual manipulation of the handle 18 (that is, in the direction of the arrow 32 in FIG. 8) the cam follower 39 is displaced in the forward direction against the biasing force of the spring 31 to move the riser 21*a* and the attached slide plate 21 and positioning member 8 in the forward direction. As a result of this motion, the downwardly extending projections 8*a* of the positioning member 8 enter the space between adjacent sinker elements 20 and positively located or position the carrier 3 relative to the needle bed 1 and the sinker elements 20, and the rear extension 28 of the slide plate 21 contacts the upwardly extending tab 24*a* to pivot the bail 24 in the clockwise direction, as shown in FIG. 9, to cause the loop expanding member 7 to enter the space between two adjacent knitting needles 2, as shown in FIG. 10, and deflect the right-hand needle in the rightward direction. As the cam 13 continues its clockwise rotation, the slide plate 21 is urged rearwardly by the spring 31 causing the projections 8*a* to retract from between the sinker elements 20 and the bail 24 to pivot counterclockwise to remove the loop expanding member 7 from between the knitting needles 2.

As shown in FIGS. 2, 4, 5, and 9, the linking needle 9, which functionally corresponds to the type of tool described above in connection with the description of FIG. 27, includes a hook 9*a* and a latch 9*b*. The linking needle 9 is mounted on a support plate 33 on the forward side of the carrier 3 with the linking needle horizontally aligned at approximately the same elevation as the knitting needles 2 with the hook 9*a* spaced from and in opposing relation to the knitting needles 2.

The support plate 33 is formed as a substantially L-shaped member and includes a horizontally aligned portion 33*a* that is mounted in sliding relationship against the underside of the carrier 3 and a shorter, depending leg 33*b* which carries the linking needle 9. The horizontal portion 33*a* has a forwardly mounted guide pin 35 (FIG. 2) and a rearwardly mounted guide pin/cam follower 36 (FIG. 4) secured to its upper surface with the pin 35 and the cam follower 36 extending upwardly through slots 37 formed in the carrier 3. A retainer (unnumbered) is secured in threaded engagement with the upper, projecting end of the guide pin 35 so that the support plate 33 is adapted to slide in a direction generally transverse to the longitudinal axis of the needle bed 1 to the extent permitted by the slots 37. The cam follower 36 extends upwardly from the rear end of the support plate 33 and is adapted, as described below, to pass through an appropriately sized opening in the riser 21*a* to contact the control surface of the cam 14. The cam follower 36 is resiliently urged into contact with the cam 14 by a spring 41 connected, in tension, between a lug 39 (FIG. 4) that extends through an opening 40 from the support plate 33 to another lug 30*a* (FIG. 2).

Figure 5:
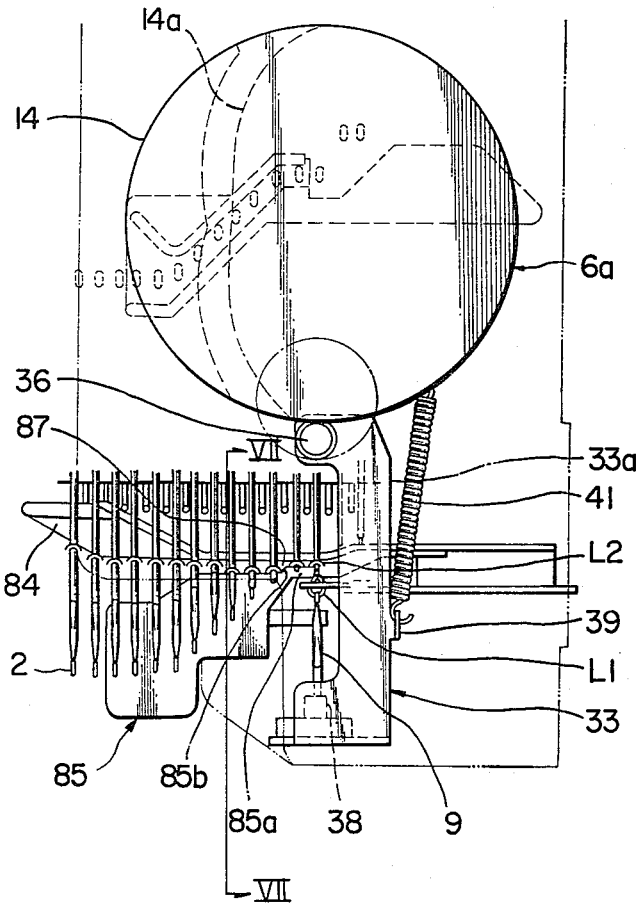
FIG. 5 is a partial plan view, in diagrammatic form, showing the operative relationship between a linking needle and its actuator cam.
Figure 6:
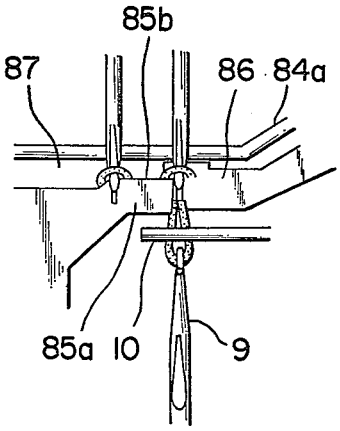
FIG. 6 is an enlarged detail view of the linking needle shown in FIG. 5 with its associated parts.

The linking needle 9 is supported on its end remote from the hook 9*a* in a holder 38 that is secured to the depending leg 33*b* of the support plate 33. As shown in FIGS. 5 and 9, the linking needle 9 is generally in alignment with the knitting needles 2, at the same general elevation as the knitting needles, with the hook 2*a* of the knitting needles and the hook 9*a* of the linking needle 9 generally opposite one another.

Figure 12:
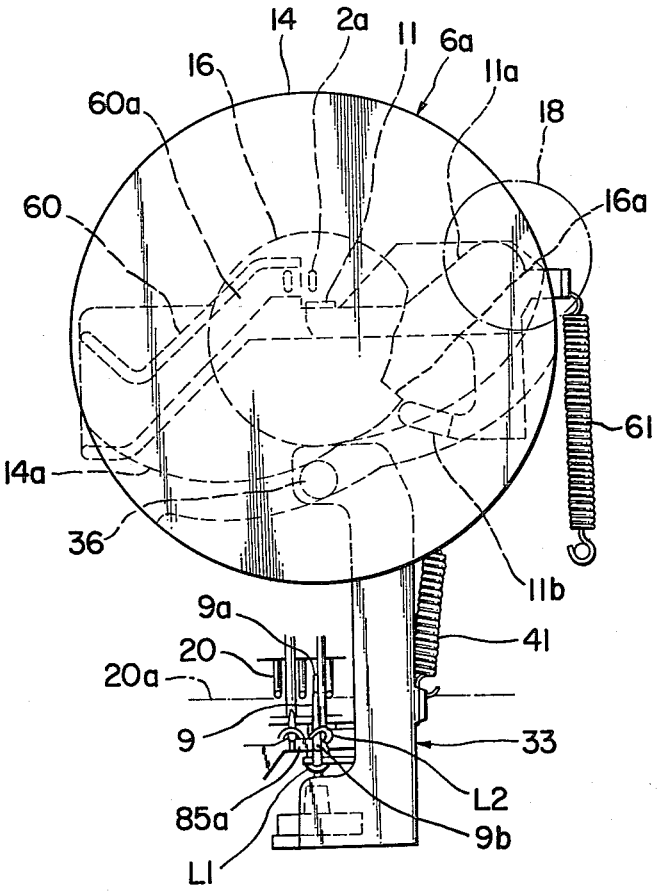
FIG. 12 is a partial plan view, in diagrammatic form, showing the operative relationship between a needle operating cam and the linking needle and their operatively associated actuator cams.

As shown in FIGS. 5 and 12, the cam 14 has a generally circular shape with the cam profile defined by a peripheral surface portion of the cam 14 and a cam track 14*a* formed on the underside of the cam. A notch 14*b* is provided on the periphery of the cam and is adapted to engage the folded, distal end of a leaf spring 34 (FIGS. 1 and 2) that functions a detent to assist in defining the initial position of the cam block 6*a*.

When the actuator mechanism 6 is in its initial or starting position, as shown in FIGS. 1 and 5, the cam follower 36 is resiliently urged into contact with the peripheral portion of the cam 14. As the cam 14 is rotated by manual manipulation of the handle 18 in the clockwise direction about the support shaft 19, the cam follower 36 rides along the peripheral surface portion of the cam 14 and, after approximately one-half a revolution of the cam 14 (that is, approximately 180°), the cam follower 36 enters the trackway 14*a*. With continued rotation of the cam 14, the support plate 33 and the attached linking needle 9 are displaced in the rearward direction to move the hook 9*a* of the linking needle 9 across and rearwardly of the line of alignment 20*a* (FIG. 1) of the sinker elements 20. With further rotation of the cam 14, the cam follower 36 exits the track 14*a* returning the support plate 33 and the linking needle 9 to their initial or home position.

The timing relationships of the cam 14 relative to the cam 13 is such that the linking needle 9 reaches its most rearward position after the cam 13 has effected its control of the loop expanding member 7 and the positioning member 8.

As is shown in FIGS. 1, 2, 3, and 4, the loop restricting member 10 is defined by a needle or pin that is attached to and extends from one end of a link 10*a*. The link 10*a* is movably mounted on the forward side of depending wall 42 (FIG. 4) that is secured to the underside of the carrier 3 near the marginal edge of the opening 40. The link 10*a* includes a slot formed at the end remote from the pin 10 and a round opening formed through the link intermediate its ends. The link 10*a* is supported for sliding movement relative to the wall 42 by a mounting pin 44 that is secured to the wall 42 and that passes through the slot 44 with an enlarged head portion of the pin 44 retaining the link 10*a* against the wall 42. A bracket (unnumbered) supports the other end of the link 10*a*. An eccentrically mounted cam 45 having a peripheral cam surface that includes a stepped portion is located in the hole such that rotation of the cam 45 will cause the link 10*a* to move upwardly and downwardly and to the left and to the right relative to the mounting wall 42 as shown in sequence in FIGS. 20–23 and as explained below. A braking arm 45*a*, pivotally mounted on the forward side of the mounting wall 42, is urged against the cam 45 to prevent unintentional or spontaneous movement thereof. The cam is connected directly to a pinion gear 46 (shown in broken-line illustration in FIGS. 20–23) which, in turn, engages a larger spur gear 47 (FIGS. 1, 2, 4, and 17) that is rotatably mounted on a pivot pin 49. The spur gear 47 is provided with four equally spaced pins 50 that extend axially from the rear side of the gear. The respective ratios of the gears 47 and 46 are such that approximately one quarter of a revolution of the larger spur gear 47 will cause one entire revolution of the pinion gear 46 and the attached cam 45 to cause the loop restricting member 10 to move through one complete operating cycle as shown in FIGS. 20–23.

A leaf spring 58, connected to the mounting plate 42 by a threaded fastener, includes a distal end portion which engages two of the four pins 50 of the spur gear 47 to prevent unintentional spontaneous movement thereof.

The gear 47 is caused to rotate by an actuating member 48 (FIGS. 1 and 17) that is operatively connected with the cam 15. The actuating member 48 is formed as a substantially flat member and is pivotally mounted on the upper side of the carrier 3 by a pin 51 for limited pivotal motion defined between the solid-line illustration and the broken-line illustration in FIG. 17. The rear portion 48*a* of the actuating member 48 includes a cam follower 52 that is generally at the same elevation as and adapted to engage the control surface of the cam 15. A wire torsion spring 57 located at the pivot pin 51 resiliently urges the cam follower 52 into contact with cam 15.

A pivotally mounted feed pawl 53 is located at the end of the forward extending portion 48*b* of the actuator member 48. The pawl 53 is rotatable about a pin 55 and includes a slotted portion (not shown) through which a pivot pin 54 extends. A wire torsion spring 56 resiliently urges the distal or free end of the feed pawl 53 in the downward direction.

Figure 21:
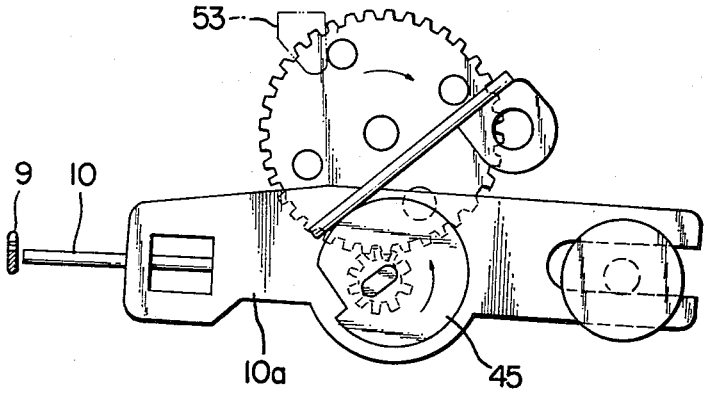
FIG. 21 is a partial, elevational view, similar to that of FIG. 20, showing the position of the loop restricting member relative to the linking needle during a first portion of the operating cycle.
Figure 22:
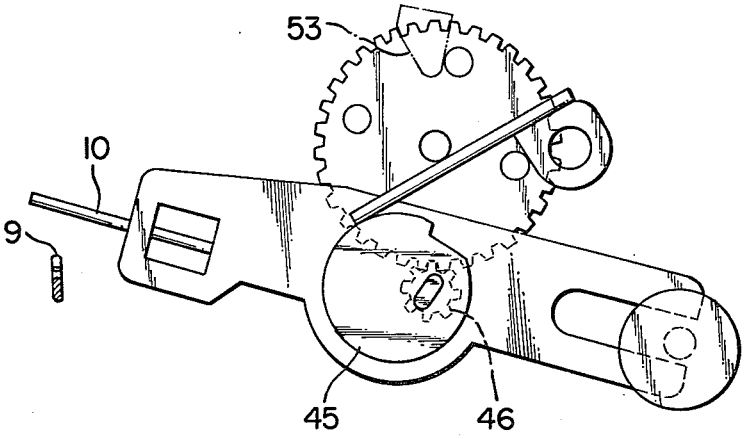
FIG. 22 is a partial, elevational view, similar to that of FIGS. 20 and 21, showing the position of the loop restricting member relative to the linking needle during a second portion of the operating cycle of the loop restricting member.

The actuator cam 15 includes both a peripheral surface portion and trackway 15*a* defined by a minor cam section 15*b*. As described above, the cam follower 52 is resiliently urged into contact with the cam 15 and when the cam 15 is in its initial position, as indicated by the solid-line illustration in FIG. 17, the actuating member 48 is in its initial, solid-line position. As the cam 15 is rotated by manual manipulation of the handle 18 in the clockwise direction as indicated by the arrow in FIG. 17, the cam follower 52 is urged into the trackway 15*a* and moved along the cam surface on the inside of the cam section 15*b*. The actuator member 48 pivots in the counter-clockwise direction from the solid-line position to its broken-line position causing the feed pawl 53 to engage one of the pins 50 on the spur gear 47 and to rotate the gear 47 through approximately 90°. As shown in sequence in FIGS. 20–23, the feed pawl 53 describes an arcuate path moving rightwardly and upwardly to rotate the spur gear 47 approximately one-quarter a revolution. As a consequence of the rotation of the spur gear 47, the pinion 46 and the attached eccentric cam 45 are rotated through approximately one full revolution moving the loop restricting member 10 upwardly and to the right and then downwardly as shown in FIGS. 20–23. More specifically, in FIG. 20, the loop restricting member 10 is in its initial or operative position with the distal end of the braking member 45*a* engaging the stepped or notched portion of the cam 45 surface. As the feed pawl 53 moves to the right under the control of the cam 15, it engages one of the pins 50 to rotate the spur gear 47 in the clockwise direction and, accordingly, rotate the pinion gear 46 and the attached cam 45 in the opposite, counterclockwise direction as indicated by the arrows in FIGS. 20 and 21. As the cam 45 rotates, the link 10*a* simultaneously slides to the right and pivots upwardly, as shown by an inspection of FIGS. 20 and 21 and then shifts to the left as it continues it upward pivoting as shown in FIG. 22. The link 10*a* then pivots downwardly as indicated by an inspection of FIGS. 22 and 23 to return to its initial, operative position.

Figure 15:
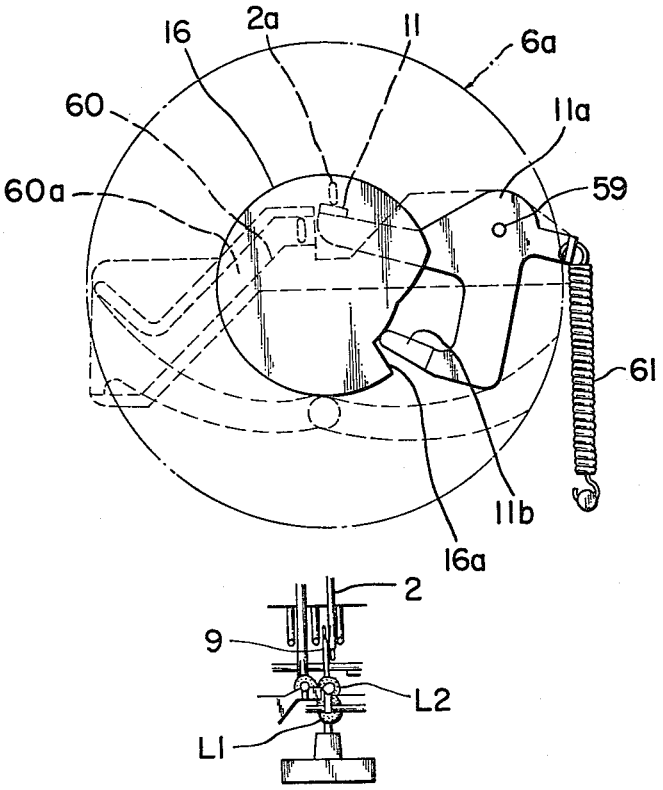
FIG. 15 is a partial plan view, in diagrammatic form, showing the operative relationship between a needle operating cam and its associated actuator cam.

The needle operating cam 11 is formed as part of a bell crank 11*a* (shown in FIG. 15 and in broken-line illustration in FIG. 12). The bell crank 11*a* is rotatably mounted on a pivot pin 59 on the underside of the carrier 3. The needle operating cam 11 is defined by a tab at the distal end of an arm of the bell crank 11*a* with the tab normally positioned adjacent the exit opening of the track way 60*a* of the needle butt cam 60 and is adapted to contact the butts 2*a* of the knitting needles 2 as they exit the track way 60*a*. The other arm of the bell crank 11*a* is provided with a cam following end portion 11*b* at the distal end thereof. The cam following portion 11*b* extends through an opening in the carrier 3 to engage the control surfaces of the cam 16 and is resiliently urged into contact with the cam 16 by a spring 61 that pivots the bell crank 11*b* in the clockwise direction about the pivot pin 59 as shown in FIG. 15. The spring 61 extends, in tension, on the upper side of the carrier 3 between an upwardly extending lug of the bell crank 11*a* and a pin (unnumbered) secured to the upper side of the carrier 3.

The cam 16 is formed as a peripheral cam with a recess 16*a* formed in its periphery. When the cam 16 is in its initial position, the cam follower end portion 11*b* engages the periphery of the cam to position the needle operating cam 11 in the position shown in FIG. 12 immediately forward of the butt 2*a* of the knitting needle 2 which has exited the guideway 60*a* of the needle butt cam 60.

When the cam 16 is rotated to the position shown in FIG. 12, the cam follower end portion 11*b* of the bell crank 11*a* enters the recess 16*a* of the cam permitting the spring 61 to pivot the bell crank 11*a* in a clockwise direction. The needle operating cam 11 contacts the butt 2*a* of the needle 2 at the exit of the track way 60*a* to force the needle to the rearward direction beyond the knock-over or cast-off position.

Further rotation of the cam 16 causes the cam follower end piece 11*b* to exit the recess 16*a* and return to the peripheral portion of the cam 16 to rotate the bell crank 11*a* counterclockwise (FIG. 15) against the force of the spring 61 to return the needle operating cam 11 to its initial position.

As shown in FIGS. 1, 2 and 3, the carriage feed or translating mechanism 12, which is designed to increment the carrier 3 along the needle bed 1 in a needle-by-needle sequence, includes a feed or a drive gear 63 that is adapted to engage a rack-like element 67 on a rear, upwardly extending wall 66 of the needle bed 1. Rotation of the drive gear 63 causes the carrier 3 to move along the needle bed 1 in the longitudinal direction thereof.

A ratchet wheel 62 is secured to the underside of the drive gear 63 with both the ratchet wheel and the gear rotatably mounted on a shaft 65 that is secured to and extends upwardly from a movable base plate 64. The base plate 64 is movably mounted on the upper side of the rearward portion of the carrier 3 to permit the drive gear 63 to engage the rack 67. A spring-loaded click or detent member 70, which includes a conventional spring-biased roller, is provided to prevent unintentional or spontaneous movement of the drive gear 63.

The base plate 64 is provided with guide slots (not shown) in two predetermined spaced positions with the slots engaging the pivot pin 19 and a guide pin (not shown) that is provided on the upper side of the carrier 3. The base plate 64 is movable under the control of a switch plate 71 with the range of movement limited by the guide slots.

The switch plate 71 is provided with a pair of guide slots 72 (only one of which is shown in FIG. 1) in opposite side portions thereof and with an angularly extending guide slot (not shown) in the central portion thereof. The angularly extending guide slot engages the shaft 65 of the drive gear 63 at a position beneath the base plate 64 with the guide slots engaging threaded fasteners 73 which constrain the switch plate 71 for movement to the left and to the right as shown in FIG. 1 to the extent limited by the slots 72. A lever 74 is connected to one side of the switch plate 71 to effect movement thereof.

A wire spring 75, having one end secured to the other side of the carrier 3 by a threaded fastener and the other end engaging the switch plate 71, is provided to prevent unintentional or spontaneous movement of the switch plate 71. A spring 76, which extends in tension between a lug 77 on the side of the base plate 64 and the carrier 3, is provided to resiliently urge the base plate 64 in a rearward direction.

The cam 17 and the drive gear 63 are operatively connected to one another through an actuating link 69 (FIG. 1) that is located on the upper side of the carrier 3 and that is pivotally mounted for movement about a pivot pin 78. The forwardly extending portion of the link 69 carries a cam follower 79 for engagement with the control surfaces of the cam 17 and the rearwardly extending portion of the link 69 carries a feed pawl 68 pivotally mounted on a pin 80. A wire torsion spring 83 resiliently urges the pawl 68 into engagement with the teeth of the ratchet wheel 62. A helical spring 82, connected in tension between a lug 81 on the rearwardly extending portion of the actuator link 69 and a pin secured to the upper side of the carrier 3, resiliently urges the actuator link 69 in a clockwise direction about the pivot pin 78 to bias the cam follower 79 into engagement with the cam 17.

When the switch plate 71 is set in its left position, as shown in FIG. 1, the shaft 65 is positioned in a rear portion of the aforementioned angular guide slot of the switch plate 71 to cause the drive gear 63 to mesh with the rack 67 and to cause the cam follower 79 to engage the cam 17. Conversely, when the switch plate 71 is set to its right-hand position, the shaft is displaced to the forward portion of the aforementioned angular guide slot (as a consequence of the shifting of the base plate 64 in a forward direction to an inoperative position) to cause the drive gear 63 to disengage from the rack 67 and the cam follower 79 to disengage from the cam 17.

As shown in FIG. 1, the cam 17 is a peripheral surface-type cam that includes a recess 17*a* formed on the periphery of the cam. When the cam 17 is in its initial position as shown in FIG. 1, the cam follower 79 is located in a recess 17*a*. When the switch plate 71 in its leftward position and the drive gear 63 is engaged with the rack 67, rotation of the cam 17 in a clockwise direction by manual manipulation of the handle 18 will cause the cam follower 79 to ride out of the recess 17*a* onto the peripheral portion of the cam causing the actuating link 69 to pivot in a counterclockwise direction against the biasing force of the spring 82. The feed pawl 68, which engages a tooth of the ratchet wheel 62, moves leftward to rotate the ratchet wheel 62 the equivalent of one tooth space. As a result, the attached drive gear 63 is rotated in the same direction through a single tooth angle to move the carrier 3 to the left in FIG. 1 by a distance corresponding one pitch of the knitting needles 2.

Figure 4:
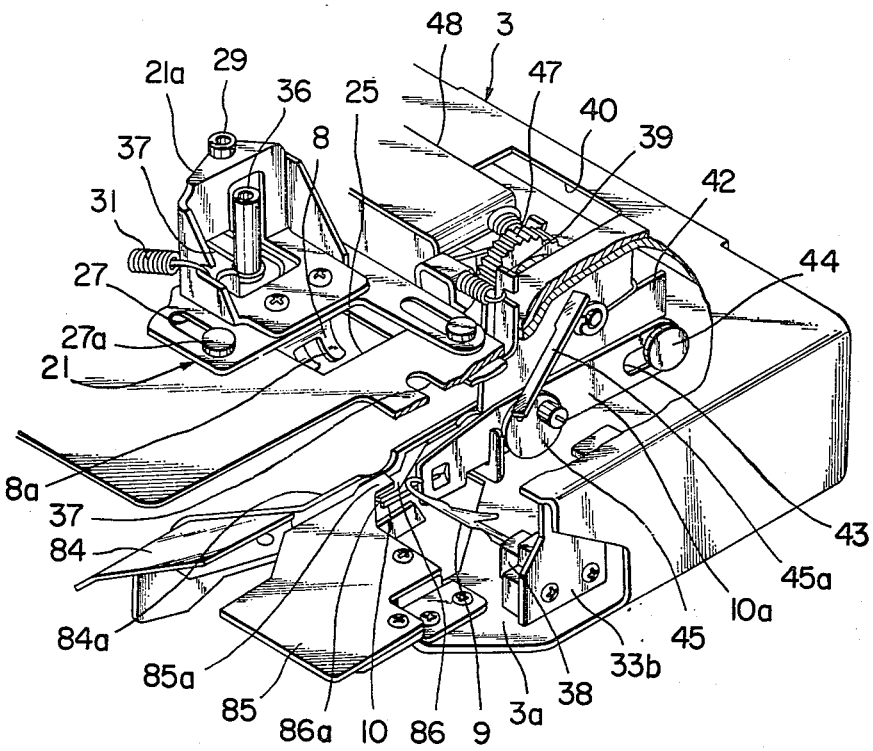
FIG. 4 is a partial, enlarged perspective view of the front portion of the fabric manipulating device of FIGS. 1, 2, and 3 with selected portions thereof broken away for reasons of clarity.
Figure 19:
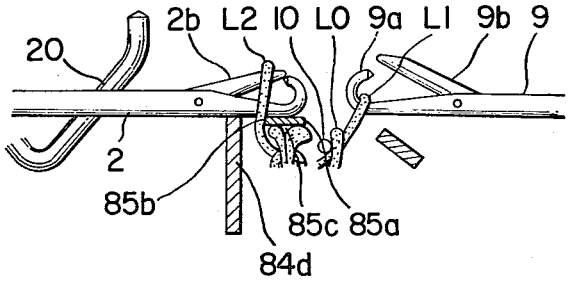
FIG. 19 is a partial side elevational view, similar to that of FIG. 14, showing the relative position of the loop restricting member.
Figure 20:
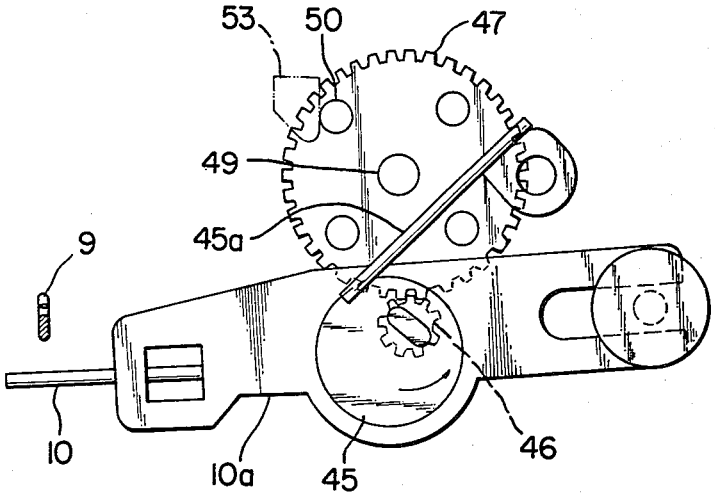
FIG. 20 is a partial, front elevational view in diagrammatic form, of the loop restricting member and associated parts at the beginning of the loop restricting member operating-cycle.

In addition to the cam-operated mechanisms described above, the fabric manipulating device is provided with a plurality of stationary loop contact surfaces which are designed to contact the loops and control their orientation. As shown in FIGS. 1, 4, and 5, the loop control surfaces include a platelike loop guide member 84 that is attached to a downwardly extending portion 3*a* on the front side of the carrier 3. The guide member 84 includes a holding portion 84*a* defined between contiguous side edges 84*b* and 84*c* which are disposed, respectively, askew and parallel to the direction of travel or movement of the carrier 3 to guide a loop on the knitting needles 2 into the locus of movement of linking needle 9 by sliding contact. The loop control surfaces also include a fixed loop suppressing member 85 in the form of a plate which is secured to the forward, right-hand side portion of the carrier 3 with a rearward edge of the loop suppressing member 85 facing the loop guide member 84 to define a narrow guideway 87 therebetween that is generally transverse to the direction of movement of the linking needle 9 and generally parallel to the direction of movement of the carrier 3 relative to the needle bed 1. As shown in FIG. 5, the loop suppressing member 85 includes a right-hand end portion 85*b* that is located at a point to the left of the linking needle 9 and in proximal relationship to the locus or path of movement to the linking needle. The rear edge of the loop suppressing member 85 is adapted to engage a needle loop L2, as illustrated in FIG. 19, as the loop is guided along the guideway 87 into the locus of movement of the linking needle 9 to prevent the loop L2 from inadvertently clearing the latch 2*b* of the knitting needle 2. The underside of the end portion 85*b* is adapted to engage loops, for example, the loops LR and LF in FIG. 7, which are supported from the needle loop L2, and position the loops below the plane of reciprocating movement of the linking needle 9 to prevent their inadvertent upward movement.

A loop-stopping member 86 is provided, as part of the loop expanding means, for cooperation with a loop expanding member 7. The loop-stopping member 86, as shown in FIGS. 4, 6, 10, and 11, is attached to the right, front side of the support portion 84*a* of the loop guiding member 84 and has an inner end 86*a* positioned in a plane that is below and proximal to the locus of movement of the linking needle 9 and in partial, vertically overlapping relationship with the right-hand end 85*b* (FIGS. 6 and 11) of the loop restricting member 86. The inner end 86*a* is adapted to contact and engage the lower portion of a needle loop, for example, the loop L2 shown in FIG. 11, as the loop is pulled wide; that is, pulled to the right in FIG. 11 by the action of the loop expanding member 7 as it deflects the knitting needle 2, and tranversely confine or hold the loop L2 in position.

Figure 24:
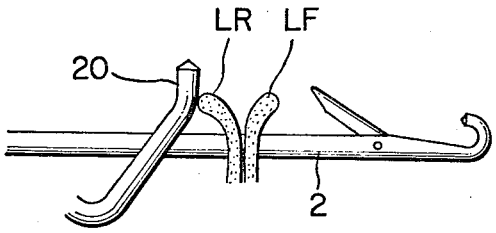
FIG. 24 is an enlarged side elevational view, in diagrammatic form, showing the end loops of two knitted webs on the stem portion of a knitting needle.
Figure 25:
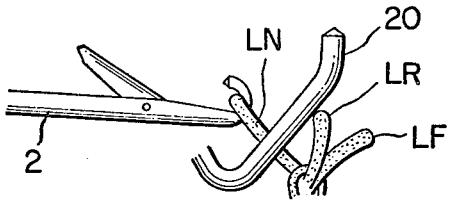
FIG. 25 is an enlarged side elevational view in diagrammatic form, similar to that of FIG. 24 showing a new loop on the hook of the knitting needle being pulled through the end loops of the two knitted webs.

In operation, the various actuator cams of the cam block 6*a* and their associated cam follower mechanisms operate in timed relationship with one another and in cooperation with the fixed loop control surfaces to perform the loop manipulation operations described above. For example, in connecting two knitted webs together, the front sides of the forward and rearward webs are overlapped with their respective loops LF and LR on the end or terminal courses on the forward and rearward webs placed in a loop-by-loop sequence on successive knitting needles as shown in FIG. 24. In preparation for the loop linking operation, the knitting carriage (see FIG. 27) moves along the needle bed 1 while feeding fresh yarn to knit an additional course thereby forming a row of new needle loops LN in the hooks 2*a* of the knitting needles 2 with these new loops pulled through and supporting the two loops LF and LR that have been knocked-over or cast-off the knitting needle latches as shown in FIG. 25. With the knitting needles 2 held close to the sinker elements 20, the knitting needles 2, which carry the new loops LN, are manually shifted to their forward, projected position to carry the new loops LN onto the knitting needle stems. Weights may be placed on the opposite ends of the two webs to assist in performing the above preliminary operations.

After these preparatory steps, as shown in FIG. 26, the fabric manipulating device A of the present invention (with its switch plate 71 set to the righward position) is mounted in operative position over the needle bed 1 on the right side of the knitting needles 2 that carry the two webs (generally indicated at B). The fabric manipulating device A is then moved leftward to a point close to the web-carrying knitting needles 2 and the switch plate 71 is then moved or set to its leftward position to cause the drive gear 63 to engage the rack 67 on the needle bed 1 as described above. The detent member 70, which engages the teeth of the feed gear 63, thereby establishes the initial position of the fabric manipulating device A.

The handle 18 is then manually operated in a clockwise direction a suitable number of revolutions to cause the cam block 6*a* and the associated cams to effect the above described manipulations with one revolution of the cam block 6*a* taking place for each of the above described manipulations.

Figure 18:
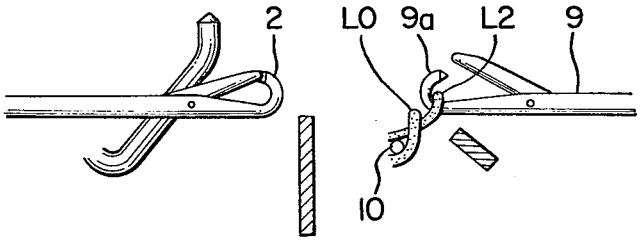
FIG. 18 is a partial side elevational view, similar to that of FIG. 14, showing the relative positions of the linking needle when the linking operation for one loop is complete.

When the cam block 6*a* is in its initial position, that is, with the handle 18 in the most forward position as shown in FIG. 1, the old loop L1, which has been transferred to the linking needle 9 by the previous rotation of the cam block 6*a* is held on the hook 9*a* of the linking needle 9, a shown in FIG. 18, with the old loop L1 caused to pass through a loop L0 by the previous loop manipulation operation. The loop restricting member 10 extends between the two loops L1 and L0 to engage the underside of the intermediate portion of the old loop L1. At this point in the operating cycle, the linking needle 9 opposes an empty knitting needle 2 which has thrown or cast-off the old loop L1. In accordance with the linking procedure, the old loop L1 is then passed through a loop that is located on the closed latch 2*b* of the next leftwardly adjacent knitting needle 2. As shown in FIG. 19, the loop L2 is located on the closed latch of the knitting needle 2 and is confined in the guide channel 87 on its forward side by the rear edge of the end portion 85*b* of the loop suppressing member 85 and on its rearward side by the vertical wall portion 84*d* of the loop guide member 84. The loops LF and LR of the forward and rearward webs are retained by and suspended on the loop L2 beneath the plane of reciprocating movement of the new loop LN by contact with the underside of the loop suppressing member 85*a* and are transversely confined by the loop stopping member 86 as described above.

During the initial rotation of the cam block 6*a* by manual manipulation of the handle 18, the cam 17 causes the link member 69 (FIG. 1) to pivot clockwise about the pin 78 to cause the pawl 68 to engage the next tooth on the ratchet wheel 62. The link member 69 then pivots counterclockwise to rotate the ratchet wheel 62 and the feed gear 63 and cause the carrier 3 to increment to the next adjacent needle position. As a result, the linking needle 9 carrying the old loop L1 is caused to confront the next adjacent knitting needle 2 carrying the loop L2. Also, the butt 2*a* of the next adjacent knitting needle 2 is positioned opposite to the needle operating cam 11.

Figure 23:
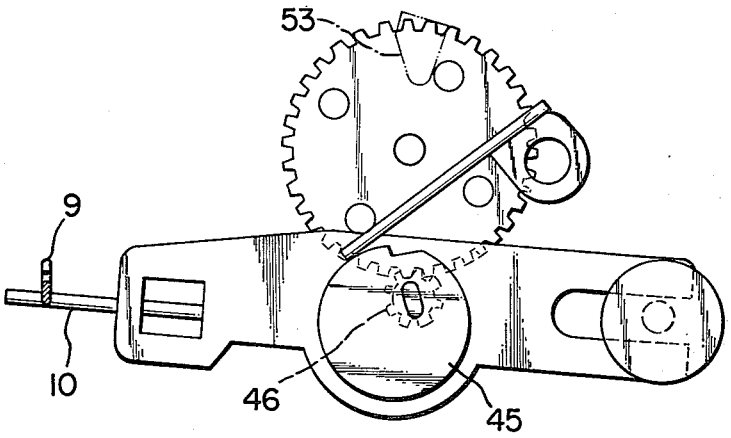
FIG. 23 is a partial, elevational view, similar to that of FIGS. 20, 21, and 22, showing the position of the loop restricting member relative to the linking needle during the final portion of the operating cycle of the loop restricting member.

As manual rotation of the cam block 6*a* is continued, the loop restricting member 10, responsive to the actuator cam 15, moves through its operational cycle as described above in connection with FIGS. 20–23. More specifically, the loop restricting member 10 withdraws from its position between the loops L0 and L1 as shown in FIG. 18 and moves to the right and upwardly as shown in FIGS. 21 and 22 and then downwardly as shown in FIG. 23 to engage the upper side of the loop L1 from above with the loop restricting member 10 then stopping in its lowermost position to push the loop L1 beneath the plane of reciprocation of the linking needle 9 as shown in FIG. 19. As a practical matter, the operation of the loop restricting member 10 is essentially trouble-free even if the operation of the carrier translation mechanism 12 under the control of the cam 17 and the loop restricting member 10 under the control of the cam 15 are operated in reverse.

Figure 11:
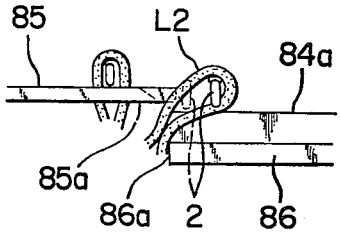
FIG. 11 is a partial elevational view of the deflected needle of FIG. 10 taken along line 11—11 of FIG. 10.
Figure 13:
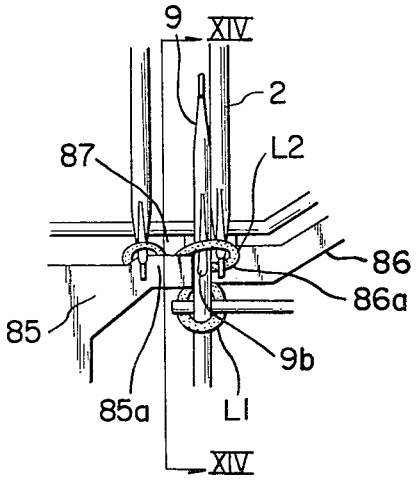
FIG. 13 is an enlarged plan view, taken from FIG. 12, showing the relative positions of the linking needle and the knitting needles.
Figure 14:
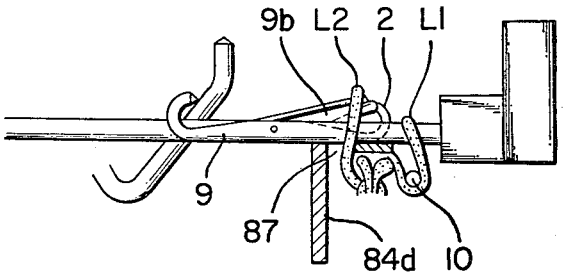
FIG. 14 is a partial side elevational view of the linking needle and knitting needle shown in FIG. 13 taken along line 14—14 of FIG. 13 and showing one step of the linking operation.

With continued rotation of the cam block 6*a*, the loop expanding member 7 and the positioning member 8, both under the control of the cam 13, move into their operative positions. The depending tabs 8*a* of the positioning member 8 enter the space between adjacent sinker elements 20 to fix the position of the carrier 3 relative to the needle bed 1, and the loop expanding member 7 enters the space between the knitting needle 2 carrying the loop L2 (that is, the knitting needle 2 that now opposes the linking needle 9) and the next leftwardly adjacent needle to deflect the knitting needle 2 carrying the loop L2 to the right, as shown in FIG. 10, and obliquely expand the loop L2 to the right as shown in FIG. 11, with the lower right portion of the loop L2 contacting the leftward edge of the loop stopping means 86. With the loop L2 in its expanded or open position, the linking needle 9, under the control of the cam 14, is moved from its initial position rearwardly with the end of the linking needle 9 plunging through the expanded loop L2. As the linking needle 9 passes through the loop L2, the loop L1, carried on the hook 9*a*, is prevented from moving with the linking needle by the loop restricting member 10. As the linking needle 9 moves toward its rearward position, the loop L1 is caused to open the latch 9*d* of the linking needle 9 and then clear the latch to move to a position on the stem of the linking needle. When the linking needle 9 arrives at its rearmost position, as shown in FIGS. 13 and 14, the loop L2 is carried on the open latch 9*b* of the linking needle 9 with the loop L1 carried on the stem and held in place by the loop restricting member 10. After the linking needle 9 has been displaced to its rearmost position, the cam 12 disengages the loop expanding member 7 from between the knitting needles 2 and the positioning member 8 from the between the sinker elements 20 and returns them to their inoperative positions under the control of the restoring force provided by return springs 26 and 31, respectively.

Figure 16:
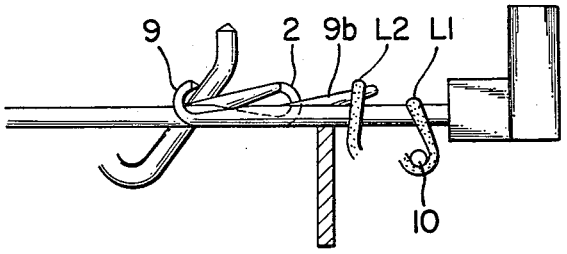
FIG. 16 is a partial, side elevational view, similar to that of FIG. 14, showing a linking needle step subsequent to that shown in FIG. 14 and corresponding to the operative relationship of the parts shown in FIG. 15.
Figure 17:
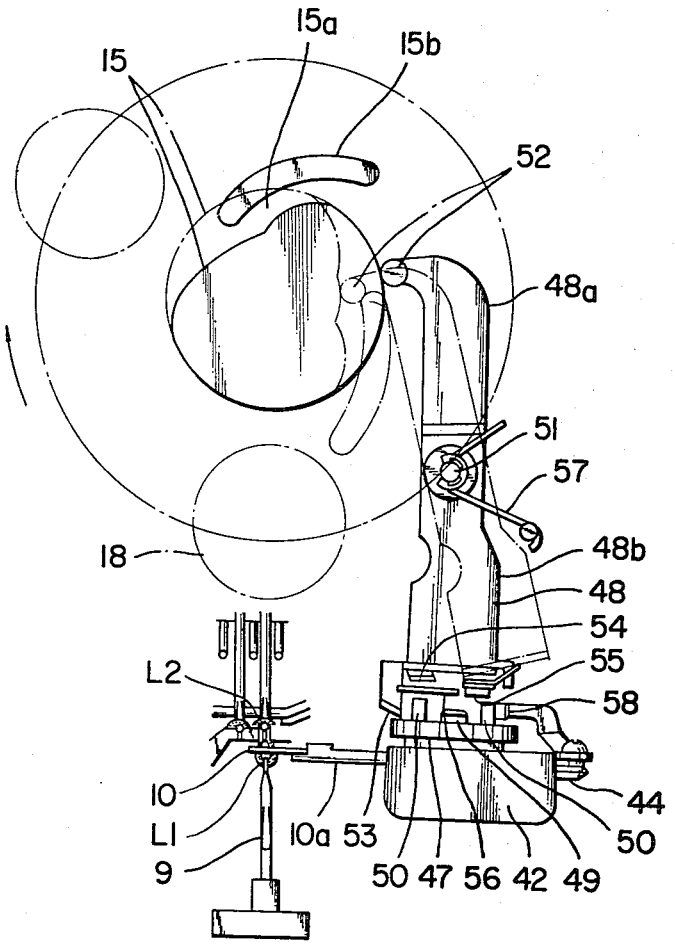
FIG. 17 is a partial plan view, in diagrammatic form, showing the operative relationship between a loop restricting member and its associated actuator cam.

With the linking needle 9 and the opposing knitting needle 2 and the loops L1 and L2 in the position shown in FIGS. 13 and 14, the cam 16, upon continued rotation of the cam block 6*a*, allows the spring 61 to pivot the bell crank 11 in a clockwise direction about the pivot 59 to cause the needle operating cam 11 to contact the butt 2*a* of the knitting needle 2 and cause the knitting needle to be displaced to its rearmost position. As a result, the loop L2 is knocked over and cast-off the knitting needle 2 and transferred from the knitting needle to the latch 9*b* of the linking needle 9 as shown in FIGS. 15 and 16.

With additional rotation of the cam block 6*a*, the linking needle 9, under the control of the cam 14, reverses its direction and is moved in the forward direction to its initial or home position. During this movement, the loop L1 on the stem of the linking needle 9 engages the open latch 9*b* from the forward side and causes the latch 9*b* to pivot onto the hook 9*a* to retain the loop L2 on the hook 9*a* with the loop L1 being knocked over and removed from the linking needle 9. As the linking needle 9 returns to its home position, the loop L2 in the hook 9*b* is pulled through the loop L1 to complete one loop manipulation.

The above described loop manipulating operation also applies to the case where the linking needle receives the first loop of the fabrics to be linked in which case, no old loop is present on the linking needle. Also, in the final stage of the linking operation of the fabrics, and as soon as the linking needle receives the last loop, the knitted webs are completely detached from the knitting machine and supported solely by the linked connection. As explained above in connection with FIG. 27, the end of the knitting yarn from the last loop is passed therethrough to prevent unravelling of the so connected webs thereby completing the intended linking operation.

Figure 27:
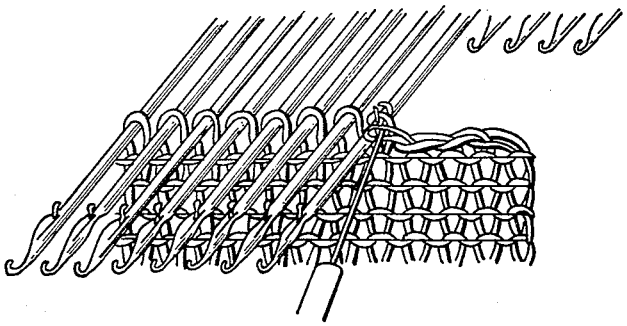
FIG. 27 is a perspective view showing one step in a conventional, manual loop linking operation.

The linking device of the present invention can be applied for various purposes including, for example, the interlocking of loops at one end of a single knitted web, as shown in FIG. 27. In any case, the knitted fabric is treated in the same way except in the manner in which it is set on the knitting machine in the preparatory stage. Since the manner of setting the knitted fabric is the same as with the conventional tappet tool, an explanation thereof is omitted.

While the present invention has been described in connection with the preferred embodiment, it is apparent to those skilled in the art that various changes and modifications can be made without departing from the spirit and scope of the invention as defined in the appended claims and their legal equivalent.

I claim:

1. In a fabric manipulating device for manipulating a knitted fabric on a knitting machine of the type having a needle bed that includes a plurality of latch needles mounted therein for individual movement in a longitudinal direction and a row of sinker elements fixed thereon in an alternate relationship with the latch needles, each needle having a latch and a butt thereon, the improvement comprising:

a carrier slidably mounted on said needle bed;

a needle member mounted on said carrier for movement in the longitudinal direction thereof across said row of said sinker elements from and to an initial position outside the range of said needles and having a hook at a rear end thereof and a latch pivotable to open and close said hook;

cam means mounted on said carrier for engagement with said butts of said needles to position same along the length thereof;

positioning means for releasably fixing said carrier in any of the needle positions so as to permit said needle member to move in a side-by-side relation with a particular needle;

loop control means for controlling needle loops to position a particular needle loop on said particular needle in a predetermined fixed position; and a manually operated actuator mechanism on said carrier including a cam for actuating said needle member to move first from said initial position to project into said particular loop under control of said loop control means and then to said initial position to catch said particular loop at the hook thereof whereupon an old loop which may have been on said needle member is knocked over therefrom.

2. The fabric manipulating device as claimed in claim 1, wherein said actuator mechanism includes a cam block mounted for manual rotation about a vertical axis fixed relative to said carrier and having a plurality of peripheral cams for controlled actuations of movable components of the device including said cam for said needle member, one complete rotation of said cam block in one direction providing one complete sequence of operations of the device for manipulating a needle loop.

3. The fabric manipulating device as claimed in claim 2, wherein said actuator mechanism includes a resilient detent member mounted on said carrier for engagement in a notch formed at an outer peripheral section of said cam block to detent said cam block in its initial position.

4. The fabric manipulating device as claimed in claim 1, wherein said loop control means includes first means mounted for engagement with needle loops on said needles to position said particular loop on and in the axial direction of said particular needle, and second means for positioning said particular needle.

5. The fabric manipulating device as claimed in claim 4, wherein said first means includes a pair of members cooperatively defining a guide way extending substantially in a parallel relation with said needle bed for guiding said needle loops on said needles to said predetermined fixed position, one of said members having at the outer end thereof a guide edge which extends obliquely towards said row of said sinker elements and is adapted to engage with said needle loops to displace said loops forwardly on said needles so as to guide them into said guide way, the other member having an inner end terminating at a position adjacent said needle member whereby the particular loop transferred to said needle member can be moved forwardly therewith without being disturbed by said other member.

6. The fabric manipulating device as claimed in claim 4, wherein said second means includes a fixed member extending in substantial parallel relationship to said needle bed below and across said needle member, said fixed member having one end terminating adjacent said needle member whereby said one end thereof is engaged, upon movement of said carrier on said needle bed, with one side of the particular loop on said particular needle so as to hold said particular loop in a fixed oblique position.

7. The fabric manipulating device as claimed in claim 6, wherein said second means further includes a movable member mounted for movement between an inoperative position in which it is inoperative to said particular needle and an operative position in which it is engaged with said particular needle at the stem thereof to forcibly flex said particular needle so as to expand said particular loop on said particular needle to assure a subsequent projection of said needle member into said particular loop, said actuator mechanism further including a cam for controlled actuation of said movable member.

8. The fabric manipulating device as claimed in claim 1, wherein said loop control means includes loop suppressor means for holding the old loop from rearward movement together with said needle member having the old loop thereon.

9. The fabric manipulating device as claimed in claim 8, wherein said loop suppressor means includes a suppressor element in the form of a pin normally extending in a parallel relationship with said needle bed below and in the rear of said needle member in said initial position, and actuating means for actuating, while said needle member is in said initial position, said suppressor element to move along a closed curved path such that said element is first moved substantially in one axial direction out of engagement with any loop and finally in the downward direction to the normal position whereby it is again engaged to hold down the loop on said needle member, said actuator mechanism further including a cam for controlled actuation of said suppressor element through said actuating means.

10. The fabric manipulating device as claimed in claim 1, wherein said positioning means includes a toothed member having at least one tooth normally disengaged from said sinker elements, and said actuator mechanism includes a cam for positioning, during movement of said needle member from said initial position, said toothed member in a position in which said tooth is engaged with two adjacent sinker elements thereby to positively fix said carrier on and relative to said needle bed.

11. The fabric manipulating device as claimed in claim 10, wherein said positioning means further includes a toothed wheel rotatably mounted on said carrier and adapted to engage with a rack provided on said needle bed along the length thereof, and a detent member resiliently urged into engagement with said toothed wheel thereby positively fixing said carrier on and relative to said needle bed.

12. The fabric manipulating device as claimed in claim 11 wherein said positioning means further includes a ratchet wheel attached to said toothed wheel, and a pawl mounted for engagement with said ratchet wheel to rotate same together with said toothed wheel a predetermined angle to thereby displace said carrier one needle space in a predetermined direction relative to said needle bed, said actuator mechanism further including a cam for controlled actuation of said pawl.

13. The fabric manipulating device as claimed in claim 11, wherein said toothed wheel is mounted on a support plate which is in turn mounted on said carrier for manual movement between a first position in which said toothed wheel is engaged with said rack of said needle bed and a second position in which said toothed wheel is disengaged from said rack to permit said carrier to be moved freely relative to said needle bed.

14. The fabric manipulating device as claimed in claim 1, wherein said cam means includes a needle lowering member normally positioned directly in front of the butt of said particular needle, and a spring for urging said needle lowering member in the rearward direction, and said actuator mechanism includes a cam for rendering, after said needle member is projected into said particular loop, said spring into operation to actuate said needle lowering member to move in the rearward direction together with said particular needle thereby to bring said particular needle out of engagement with the particular loop to permit the latter to be left on said needle member.

* * * * *